US005515565A

United States Patent [19]

Maddix et al.

[11] Patent Number: 5,515,565

[45] Date of Patent: May 14, 1996

[54] WASH LIQUID LEVEL CONTROL SYSTEM FOR AN AUTOMATIC WASHER

[75] Inventors: Beth A. Maddix; Lori S. Miller, both of Lincoln Township, Berrien County, Mich.

[73] Assignee: Whirlpool Corporation, Benton Harbor, Mich.

[21] Appl. No.: 247,160

[22] Filed: May 20, 1994

[51] Int. Cl.[6] ..... D06F 33/02

[52] U.S. Cl. ..... 8/158; 68/12.04; 68/12.05; 68/12.21

[58] Field of Search ..... 8/158; 68/12.01, 68/12.02, 12.04, 12.19, 12.21, 207; 137/387

[56] References Cited

U.S. PATENT DOCUMENTS

| | | | |
|---|---|---|---|
| 4,503,575 | 3/1985 | Knoop et al. | 68/17 R |
| 5,159,823 | 11/1992 | Fukuda et al. | 68/12.21 |
| 5,230,227 | 7/1993 | Kondoh et al. | 68/12.02 |
| 5,230,228 | 7/1993 | Nakano et al. | 68/12.04 |
| 5,235,827 | 8/1993 | Kiuchi et al. | 68/12.04 |
| 5,241,845 | 9/1993 | Ishibashi et al. | 68/12.02 |
| 5,305,485 | 4/1994 | Getz et al. | 68/12.02 X |

FOREIGN PATENT DOCUMENTS

| | | | |
|---|---|---|---|
| 1290989 | 12/1986 | Japan | 68/207 |
| 1290989 | 12/1986 | Japan | 68/207 |
| 41692 | 2/1987 | Japan | 68/207 |

*Primary Examiner*—Philip R. Coe

*Attorney, Agent, or Firm*—Stephen D. Krefman; Joel M. Van Winkle

[57] ABSTRACT

An automatic washing machine having an automatic washing liquid level control system including an ultrasonic apparatus for detecting the height of the clothes load in the washing machine and generating a signal representative of the clothes height, a control panel means for allowing user selection of the agitator speed, and means for generating a signal representative of the desired agitator speed. A control unit is provided including a fuzzy control which performs fuzzy inference on the basis of the signal representative of the clothes height and the signal representative of the agitator speed such that the optimum washing liquid level is achieved. In particular, membership functions according to fuzzy theory are defined for the clothes height and the agitator speed. Rules are defined for the height and agitator speed conditions such as for very high clothes height and low agitator speed, or medium high clothes height and high agitator speed, and so on. Each rule is executed using the fuzzy theory to thereby achieve an optimum washing liquid level.

14 Claims, 7 Drawing Sheets

| | | AGIT. RATE | |
|---|---|---|---|
| | | LOW MED | HIGH |
| HEIGHT | VHIGH | FourteenIn | FourteenIn |
| | HIGH | FourteenIn | ThirteenIn |
| | MHIGH | ThirteenIn | TwelveIn |
| | MED | TwelveIn | ElevenIn |
| | MLOW | ElevenIn | TenIn |
| | LOW | NineIn | NineIn |
| | VLOW | EightIn | EightIn |

WLEVEL Rulebase

WASH LIQUID LEVEL CONTROL SYSTEM FOR AN AUTOMATIC WASHER

BACKGROUND OF THE INVENTION

The present invention relates to an automatic liquid control system for an automatic clothes washing machine. More particularly, the invention relates to a system for achieving an optimum liquid level in the clothes washing machine by detecting the clothes load height and the speed of agitation.

The amount of washing liquid required in an automatic washer for achieving an optimum washing operation is dependent on the clothes load quantity and the desired wash cycle or agitator speed. For example, if a large clothes load is disposed in the washer, the amount of washing liquid supplied to the automatic washer must be of a quantity to adequately wash the clothes without undue clothes wear. For a quantity of clothes, if the agitation rate is high, indicating a wash cycle for sturdy clothes, the wash liquid supplied to the washer may be less than the quantity of wash liquid supplied when the selected agitation rate is low, indicating a delicate load. Additionally, at lower speeds, some loads require extra water for roll-over and less wear. Accurate clothes load quantity and agitator speed information is necessary, therefore, to determine optimum washing liquid volume.

Typically, the clothes load quantity in an automatic washer is visually determined by the user who then manually selects between several predetermined washing liquid quantities using a manually adjustable liquid level switch. Various systems have also been developed for automatically determining the clothes load quantity in an automatic washer such that an optimum quantity of washing liquid may be provided.

U.S. Pat. No. 5,042,276 discloses a clothes detection means utilizing the inertia of the clothes load for determining the clothes load quantity. A motor is repeatedly energized for rotating an agitator and the clothes load disposed in a wash basket. Between each energization, a pause occurs during which the power supply to the motor is turned off while the speed of the inertial rotation of the agitator is measured to detect the clothes load quantity. The inertial rotation is measured by monitoring the back electromagnetic force created in the motor during the pause. The washing liquid level is then determined from the amount of clothes detected.

In U.S. Pat. No. 4,480,449, an automatic liquid level control is provided which measures the volume of liquid required to be added to a tub to increase the liquid level in the tub by a predetermined increment. The measured amount is compared to a reference amount corresponding to an empty tub. When the measured amount equals the reference amount, the clothes in the washer will be covered and the control terminates introduction of washing liquid into the tub.

The above described methods, however, are relatively costly and complex. It would be advantageous therefore, to develop a system which is relatively less expensive and less complex. Furthermore, it would be advantageous to develop a washing liquid fill system which could accurately determine the clothes load quantity and also account for any significant deviation in clothes load height within the wash basket such as may occur if a pillow or the like is placed in the wash basket. Further, it would be an improvement if such a system would receive an input representative of the selected agitator speed for modifying the water level such that an optimum water level would be provided.

In the present invention, the inventors contemplate a cloth detection system for an automatic washer utilizing ultrasonic distance measuring system for measuring the quantity of clothes in the wash basket. The agitator speed is a user selectable input, which may be controlled through a control panel provided on the console of the washer. No prior art teaches or suggests the use of ultrasonic distance measuring systems in an automatic washer for measuring the clothes heights prior to the addition of wash liquid, much less a system receiving a clothes height input and an agitator speed input for determining an optimum quantity of wash liquid.

Ultrasonic distance measuring systems for monitoring the fill level in tanks, however, are well known. Typically, in these systems, an electroacoustic transducer may be controlled such that it is used alternately as a transmission transducer and as a reception transducer. The electroacoustic transducer is preferably arranged in a container above the highest possible fill level in such a manner that the sonic or ultrasonic pulses transmitted by the transducer strike the surface of the material in the container and the echo pulses reflected at the surface of the material are sent back to the transducer. The excitation of the transducer is by electrical excitation pulses with the frequency of the sonic or ultrasonic wave. The electrical excitation pulses are generated by a pulse generator and applied via a transmission/reception switch to the transducer. The electrical reception signal generated by the transducer in response to the received echo signals are applied via the transmission/reception switch to a processing circuit which determines therefrom the time interval between the instants of transmission of a transmission pulse and the reception of an echo pulse originating from the transmission pulse. This time interval corresponds to the travel time of the ultrasonic wave in the container and is thus an indication of the filling level in the container.

U.S. Pat. Nos. 4,972,386, 4,675,854, and 4,437,497, are all examples of ultrasonic systems for monitoring the fill level within a tank which operate substantially similar to the system described above. None on these patents, however, teach or suggest a system for determining the optimum fill level and then controlling the filling of the tank to the determined optimum fill level. Rather, the systems disclosed in these patents all simply monitor the fill level.

Ultrasonic range finding systems are also well known for use in an ultrasonic range finder camera. U.S. Pat. Nos. 4,439,846, 3,522,764 and 4,199,246 all disclose the use of a sonic range-finder systems in a camera which transmit a burst of sonic energy toward a subject and receives an echo pulse from the subject for determining distance from the transmitter/receiver and the subject. Furthermore, detailed schematic circuit diagrams are shown, in these references, for controlling the ultrasonic transducer utilized within the range finding systems.

From a review of the above described background information, it would therefore appear to be an improvement in the art if a less expensive, more versatile and more accurate system was provided for determining the clothes load quantity in an automatic washer. More particularly, it would be an advancement in the art if a washing liquid level system were provided for achieving an optimum wash liquid level by based on the clothes load height and the selected agitator speed.

SUMMARY OF THE INVENTION

Accordingly, a primary object of the present invention is to provide an automatic system for determining the optimum quantity of washing liquid in an automatic washer.

More specifically, it is an object of the present invention to utilize an ultrasonic distance measuring system for determining clothes load height in a wash basket and from that information in combination with an input representative of the agitator speed determining an optimum washing liquid quantity.

Another object of the present invention is to utilize a control device which performs a fuzzy control operation for controlling the wash liquid level on the basis of a signal representative of the clothes height and a signal representative of the agitator speed.

According to the present invention, the foregoing and other objects are attained by an automatic washing machine having an automatic washing liquid level control system including an ultrasonic apparatus for detecting the height of the clothes load added to the washing machine and generating a signal representative of the clothes height, a control panel means for allowing user selection of the agitator speed and means for generating a signal representative of the desired agitator speed. A control unit is provided including a fuzzy control which performs fuzzy inference on the basis of the signal representative of the clothes height and the signal representative of the agitator speed such that the optimum washing liquid level is achieved. In particular, membership functions according to fuzzy theory are defined for the clothes height and the agitator speed. Rules are defined for the height and agitator speed conditions such as for very high clothes height and low agitator speed, or medium high clothes height and high agitator speed, and so on. Each rule is executed using the fuzzy theory to thereby achieve an optimum washing liquid level.

The automatic washer includes a vertical axis tub disposed within a cabinet and further having a rotatable perforate wash basket disposed within the tub for receiving a load of clothes and a quantity of washing liquid. The cabinet includes an openable lid disposed above the tub and the wash basket. A transducer is provided, mounted in the cabinet lid, for operating in a first mode as a transmitter for transmitting a sonic energy pulse and directing the sonic energy pulse into the wash basket and in a second mode as a receiver for generating an electronic signal responsive to receipt of a sonic echo pulse from the surface of the load of clothes disposed within the wash basket. The height of the load of clothes disposed within the wash basket may then be determined in accordance with the elapsed time between transmission sonic pulse and reception of the corresponding sonic echo pulse. The wash basket is controlled to rotate while a plurality of sonic pulses are generated and the corresponding sonic echo pulses are received such that a plurality of clothes load heights values are measured and stored. From the plurality of clothes load height values which are measured, an average clothes load height and an average clothes height deviation value may be determined. A modified clothes height value may then be determined in response to the calculated average clothes load heights and the average clothes height deviation value.

DESCRIPTION OF THE PREFERRED EMBODIMENTS

Figure 1:
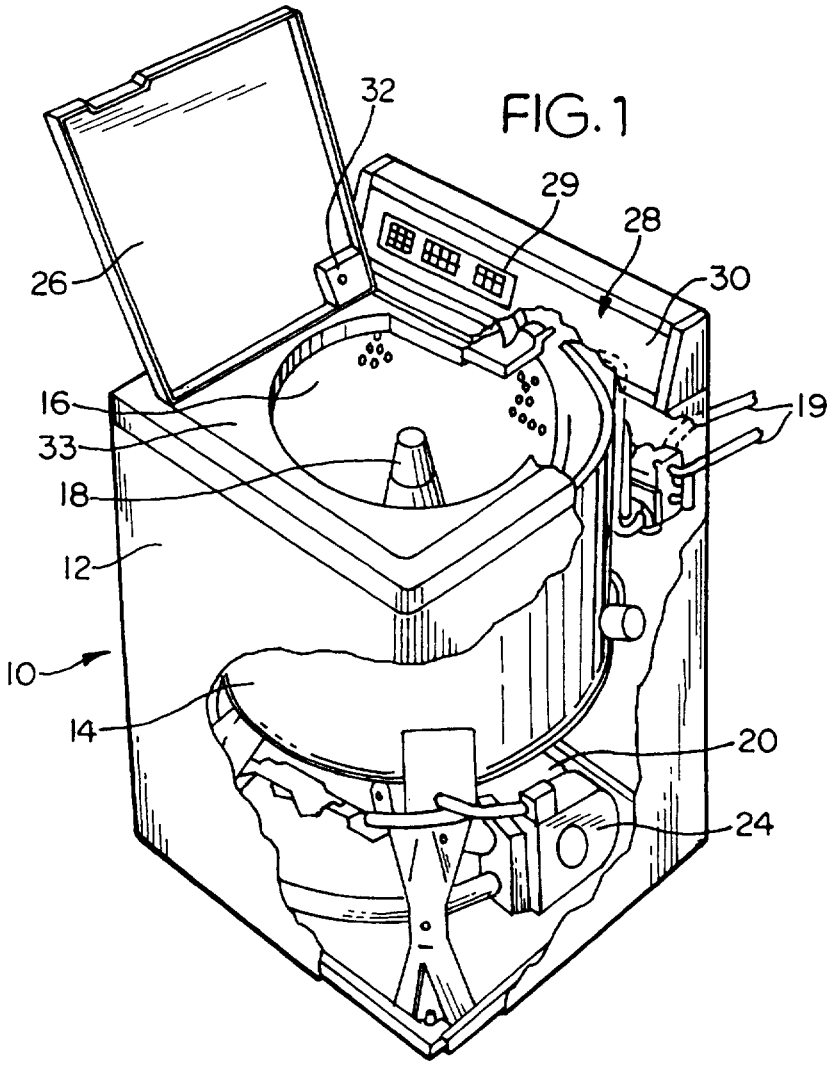
FIG. 1 is a partially cut away elevational view of an automatic washer embodying the principles of the present invention.

In FIG. 1, an automatic washing machine is shown generally at 10 comprising a cabinet or housing 12, and an imperforate tub 14, a concentrically mounted basket 16 with a vertical agitator 18, a water supply 19, an electrically driven motor 20 operable connected via a transmission to the agitator 18 and a pump 24 driven by the motor.

An openable lid 26 is provided on the cabinet top of access into the basket 16. A console 28 is provided including a cycle control panel 29 for allowing user input for selectively operating the washing machine through a programmed sequence of washing, rinsing, and spinning steps are provided on a panel 30. An electroacoustic transducer 32 is further provided, disposed on the openable lid 26 of the cabinet. The transducer 32 may also be disposed in a top assembly 33, disposed above the basket 16. The transducer 32 may be used for automatically determining the clothes height as described herein below.

Figure 2:
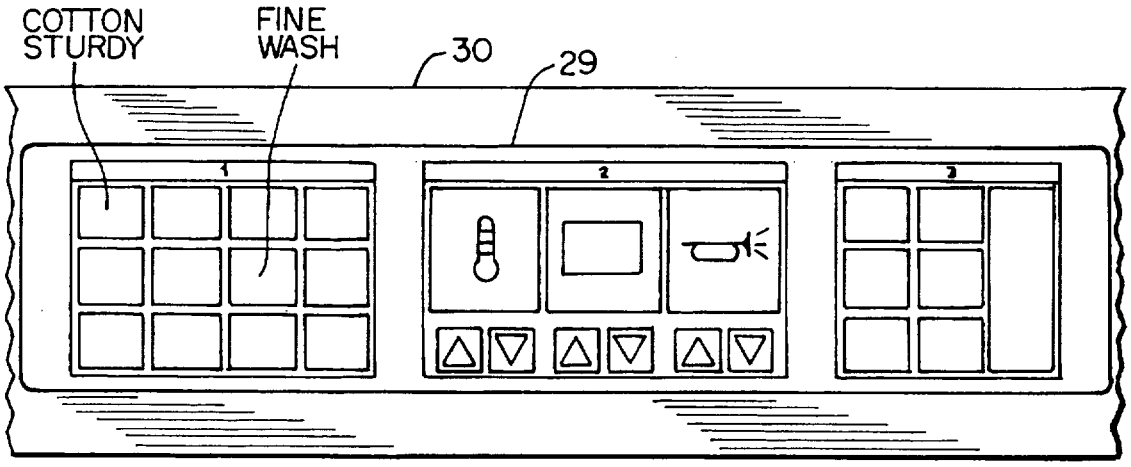
FIG. 2 is a detailed view showing the cycle control panel of the automatic washer of FIG. 1.

FIG. 2 shows a detailed view of the cycle control panel. A plurality of cycle selection buttons are provided for allowing the user to selectively determine the wash cycle. For example, a selection of the "COTTON STURDY" cycle provides a long wash cycle of high speed agitation. A selection of "FINE WASH", however, will provide a short wash cycle of low speed agitation.

Figure 3:
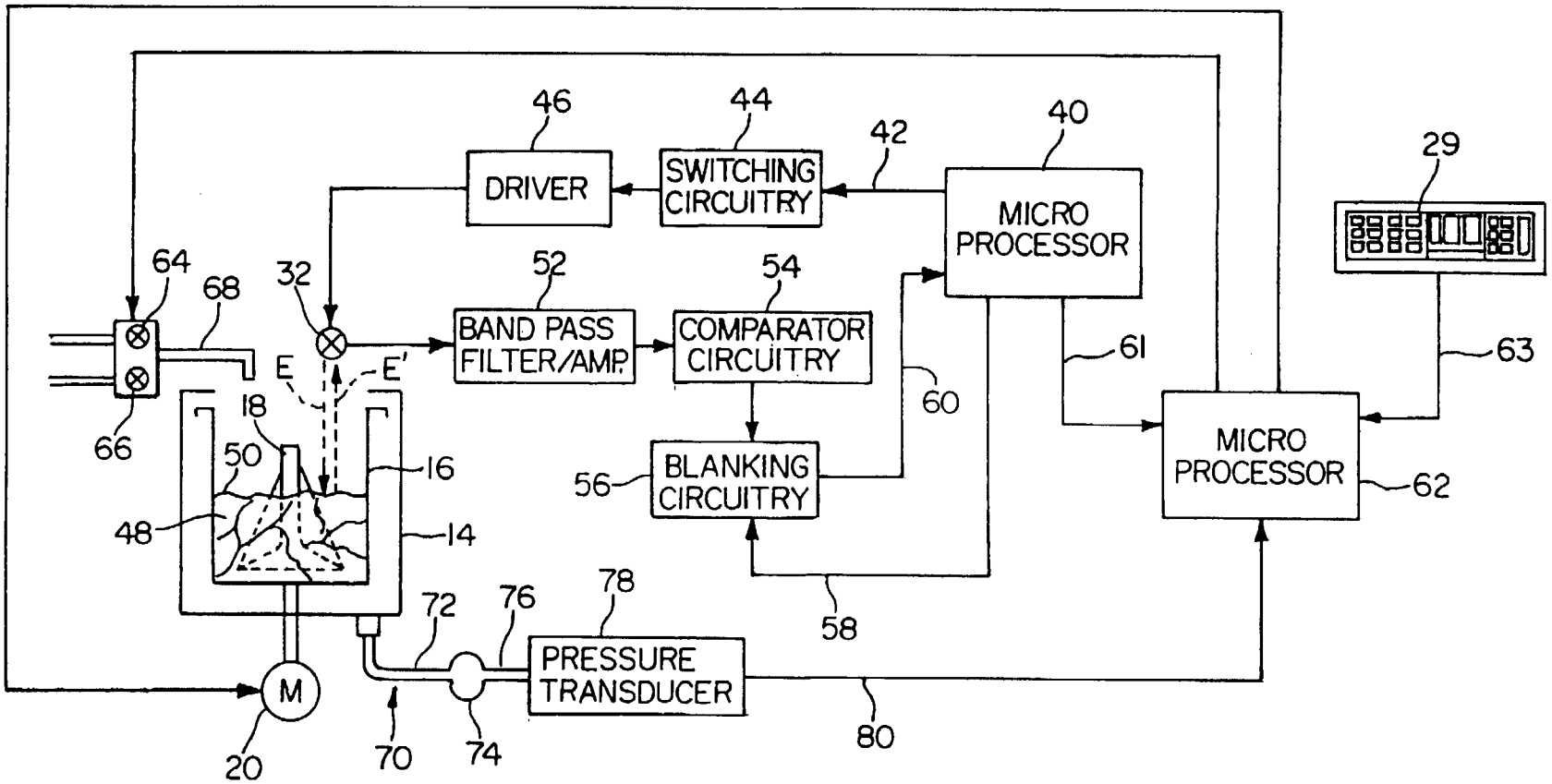
FIG. 3 is a schematic illustration of the automatic washing liquid level control system of the present invention.

FIG. 3 is a schematic diagram showing the system of the present invention for automatically filling the wash tub 14 with washing liquid to the optimum level. A microprocessor 40, such as COP820 manufactured by National Semiconductor, is provided for sending a trigger pulse on line 42 to switching circuitry 44. Within the switching circuitry 44, the trigger pulse is inverted and a voltage pulse is produced. The voltage pulse is directed to a driver 46 which typically includes a transformer for producing a high output voltage pulse or electrical excitation pulse. The electrical excitation pulse is directed to the electroacoustic transducer 32 to produce a burst of sonic energy or sonic pulse E. The burst of sonic energy E is directed downwardly into the wash basket 16 containing a load of clothes 48 having a surface 50. The burst of sonic energy E travels down to the surface at the load of clothes 48 and reflects off of the surface 50 causing sonic echo pulse E' to return to the transducer 32. The transducer 32 serves alternately as a receiver for receiving the sonic echo pulsed E' and generating a resultant signal pulse responsive to the sonic echo pulse E'.

The resultant signal pulse is directed to a band pass signal amplifier 52. The signal from the band pass signal amplifier 52 is directed to comparator circuitry 54 which allows only signals whose amplitude exceeds a fixed discriminatory threshold value to pass. The comparator circuitry 54 sends a signal to blanking circuitry 56. The blanking circuitry 56 receives an output pulse blanking signal on line 58 from the microprocessor 40 such that an erroneous triggering of the comparator circuitry by the electrical excitation pulse on line 42 or any noise which results immediately thereafter is not taken for the electronic signal pulse responsive to the sonic echo pulse E'. In this fashion, the transducer may function as transmitter and a receiver. The output of the blanking circuitry 56 on line 60 is a signal corresponding in duration to the distance from the surface 50 of the clothes 48 to the transducer 32.

From the signal, on line 60, the microprocessor 40 may determine the distance from the surface of the clothes load 50 to the transducer 32 representing the clothes height. A signal corresponding to the sensed clothes height may then be sent on line 61 to a second microprocessor 62. It can be understood that the microprocessors 40 and 62 could be combined, however, in the preferred embodiment the microprocessors are separated to reduce manufacturing requirements. The second microprocessor 62 is further provided with a signal input on line 63 from the cycle control panel 29. The cycle control panel 29 allows for user input for selectively operating the washer 10 through a programmed sequence of washing, rinsing, and spinning steps as discussed above. Dependent on the user selected cycle, the washer 10 is operated through a plurality of steps wherein the motor 20 operates to drive the agitator 18 at either a high, medium or low agitation rate, as is known. The microprocessor 62, therefore, receives signals representative of the clothes height and the desired agitator speed on lines 61 and 63, respectively. Based on these signals, the microprocessor operates to provide output signals for controlling the functions of mixing valves 64 66, as described further herein below.

Upon determining the required washing liquid level, the microprocessor 62 initiates the filling operation. During the filling operation, water enters the wash basket 16 through nozzle 68 and the water level is monitored by a pressure sensor 70. The pressure sensor 70 includes a first conduit 72 interconnected with a chamber 74 and a second conduit 76 interconnected with an analog fluid pressure transducer 78 which provides an output signal on line 80 whose frequency is a function of pressure. Such a fluid pressure transducer is disclosed in U.S. Pat. No. 4,671,116, to Glennon et al., the specification of which is incorporated herein by reference. From this signal on line 80, the microprocessor 62 may monitor the washing liquid level. The microprocessor 62 therefore is configured to terminate the flow of water through the mixing valves 64 66 when the water level sensed by the pressure transducer 78 corresponds with the required washing liquid fill level.

As described above, the microprocessor 40 causes the transducer 32 to emit a sonic burst E directed toward the load of clothes 48 disposed in the wash basket 16. A critical feature of the present invention is that the microprocessor 62 simultaneously directs an output signal for controlling the operation of the motor 20 such that the wash basket 16 is rotated while a plurality of sonic bursts are directed into the wash basket 16. In this fashion, a plurality of clothes load height measurements are made which correspond to the height of that portion of the load of clothes 48 that passes under the transducer 32 when the basket 16 rotates. Preferably, the measurement should take place at equal intervals around the wash basket.

In a manner known per se, the electroacoustic transducer 32, which operates alternately as a transmission transducer and as a reception transducer, can also be replaced by two separate transducers, one of which serves solely as the transmission transducer and the other solely as the reception transducer.

Figure 4:
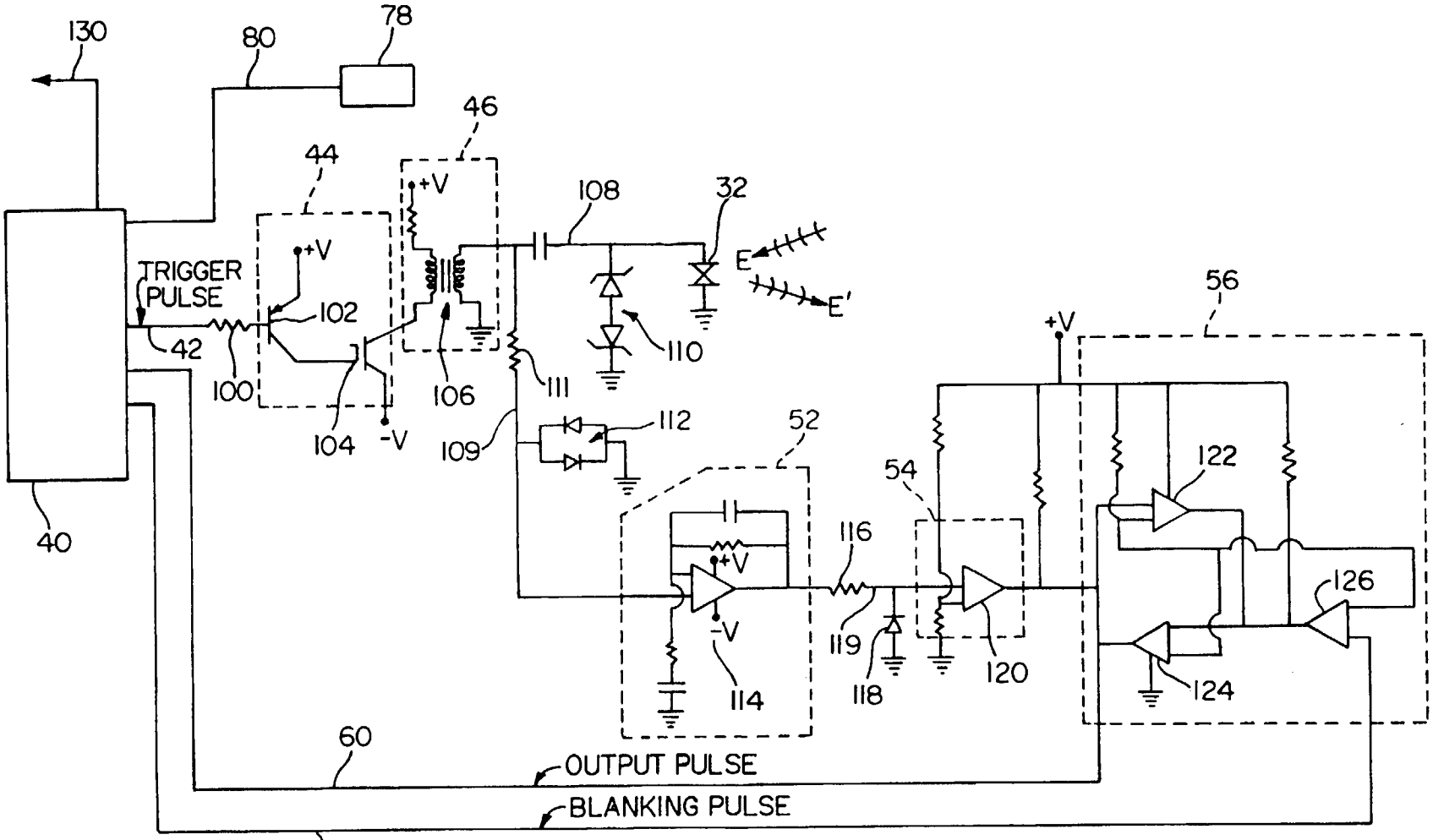
FIG. 4 is a schematic circuit diagram for the automatic washing liquid level control system of the present invention.

Details of the preferred embodiment of the apparatus of the present invention are shown in FIG. 4. The trigger pulse output of the microprocessor 40 is applied through a resistor 100 to the transistor 102. The transistor 102 amplifies and inverts the trigger pulse. The output of the transistor 102 is applied to the gate of MOSFET element 104. The MOSFET element 104 responds to the input from the transistor 102 and applies a signal to the primary of a transformer 106. A high output voltage of the secondary of the transformer 106 is applied along line 108 to the transducer 32. Zenor diodes 110 are provided to limit the output voltage applied to the transducer 32.

The output voltage on line 108 drives the transducer causing it to radiate a highly directional, correspondingly frequency-modulated burst of ultrasonic energy as indicated by arrow E. The sonic echo pulse E' produces the resultant signal pulse in the transducer applied along line 109 to a band pass signal amplifier 114. Decoupling diodes 112 function to decouple the transformer secondary from the band pass signal amplifier 52, the comparator circuitry 54 and the blanking circuitry 56. During the transmission of the high output voltage on line 108 and the transmission of the burst of sonic energy E from the transducer 32, the decoupling diodes are effectively a closed circuit to ground. However, during reception of the echo E' and the generation of the resultant signal pulse, the voltage drop across the diodes create an effect of an open circuit to the resultant signal pulse.

The output of the band pass signal amplifier is applied through a resistor 116 and a diode 118 clamps the signal 119 to ground. A comparator 120 is provided for comparing the signal on line 119 with a predetermined DC voltage. The blanking circuitry 56 is provided for blanking erroneous triggering of the comparator circuitry and receives the blanking signal on line 58 from the microprocessor 40 and comprises a plurality of amplifiers 122, 124 and a comparator 126. The output of the blanking circuitry is applied on line 60 to the microprocessor 40.

The pressure transducer 78 is further shown supplying a signal on line 80 to the microprocessor 40. As described in further detail below, the microprocessor 40 receives the input on lines 60 and 80 and sends a signal on line 130 indicative of the optimum washing liquid level.

Figure 5:
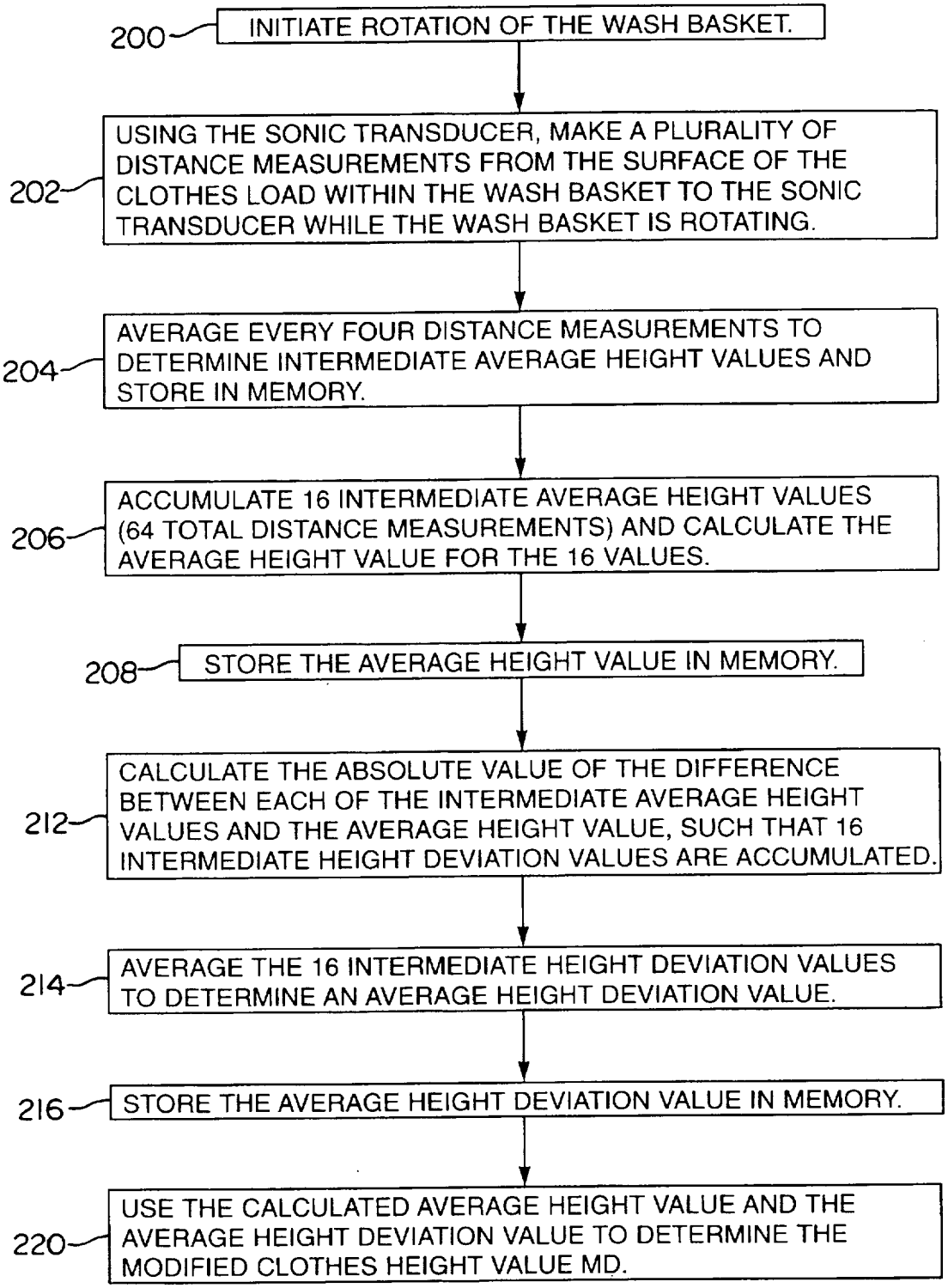
FIG. 5 is a flow chart showing the operation of the automatic washing liquid level control system of the present invention.

FIG. 5 illustrates the operation of the apparatus of the present invention during an automatic cycle of operation. FIG. 5 is in a functional block diagram form, with the various blocks indicating steps performed in sequence during the performance of the present invention.

The first step 200, as mentioned above, is the initiation of the rotation of the wash basket. Preferably the wash basket is rotated approximately 2–3 rotations while a plurality of distance measurements are made from the surface 50 of the clothes 48 to the transducer 32 as shown in step 202. These distance measurements are made in the aforementioned manner.

Steps 204, 206 and 208 illustrate the manner in which an average clothes height valve is determined. Every four distance measurements are averaged and stored in a memory register as described in step 204. The average of the four distance measurements are termed intermediate average height values. The next step 206, involves accumulating sixteen intermediate average height values requiring a total of sixty-four distance measurements and calculating an average clothes height value H. The average height value H for the load of clothes is determined from the average of the sixteen intermediate average height values. In step 208, the average height value H is stored in memory.

Steps 212, 214 and 216 illustrate the manner in which an average clothes height deviation value D is determined. In step 212, sixteen intermediate average height deviation valves are calculated by taking the absolute values of the difference between each of the sixteen intermediate average height values and the average height value. In step 214, these sixteen intermediate average height deviation values are averaged to determine the average clothes height deviation value D for the load of clothes. In step 216 the average clothes height deviation value D is then stored in memory.

Step 220 covers the use of the average clothes height value H and the average deviation value D in determining a modified clothes height value MH for use in selecting the optimum washing liquid fill level. The logic behind this step is described below. The average clothes height valve H corresponds to the average height of the load of clothes in the wash basket. However, rather than determining the optimum liquid level of washing liquid from only the average height value H, the liquid level is modified by the size of the average clothes height deviation value D. If the average clothes height deviation value D is small, the fill level may be determined based on the average height value H alone. However, if the average clothes height deviation value D is greater than some predetermining minimum, the fill level is modified to be greater than the level which would be determined based on only the average height value H. In this fashion, adequate fill levels of washing liquid are still determined in the presence of large variations in the height of the load of clothes within the wash basket. This may prevent potential clothes damages as well as poor washing results. This logic can be equated to the mental steps required by a user when manually selecting the fill level where the wash load is unevenly distributed in the wash basket such as may occur when washing pillows, blankets or the like.

Figure 6:
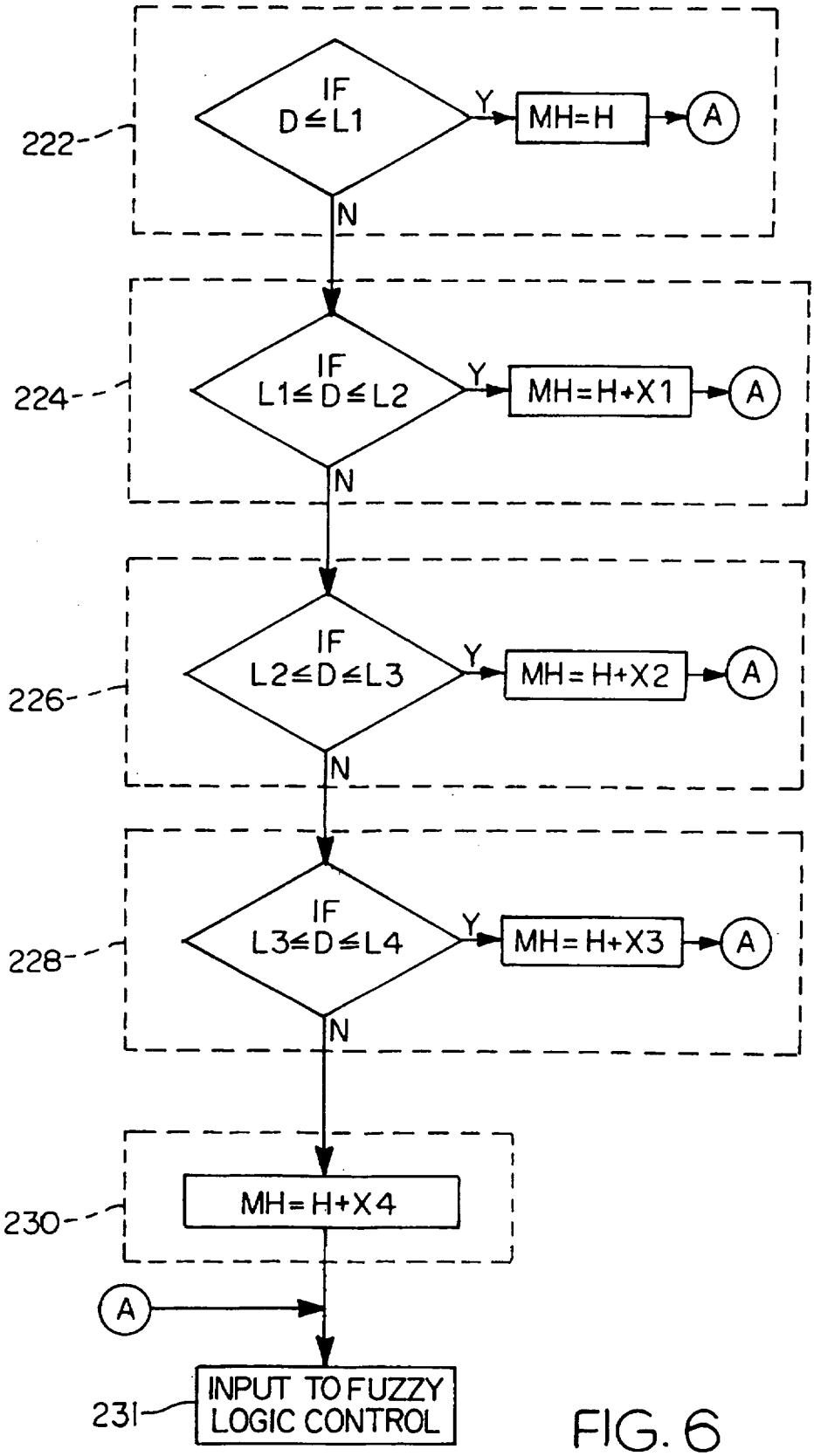
FIG. 6 is a flow chart showing the logic utilized in modifying the average clothes height value in response to the average deviation value.

FIG. 6 details the logic utilized in modifying the average clothes height H based on the average deviation value D to arrive at the modified clothes height valve MH. In step 222 it is shown that if the average deviation value D is less than or equal to a first predetermined quantity L1, then the modified clothes height value MH equals the average height value H. In step 224 if the average deviation value D is greater than the first predetermined quantity L1, but less than or equal a second predetermined quantity L2, greater than the first predetermined quantity L1, then the modified clothes height value MH equals the average clothes height value H plus a first predetermined additional height valve X1. It can be seen that this logic continues in step 226 and 228. Finally, if the average deviation value D is greater than a fourth predetermined quantity L4, then the modified clothes height value MH equals the average clothes height value H plus a fourth predetermined additional height valve X4. The modified height value MH is supplied, as shown in step 231, to a fuzzy logic control as will be described in further detail hereinbelow.

Figure 7:
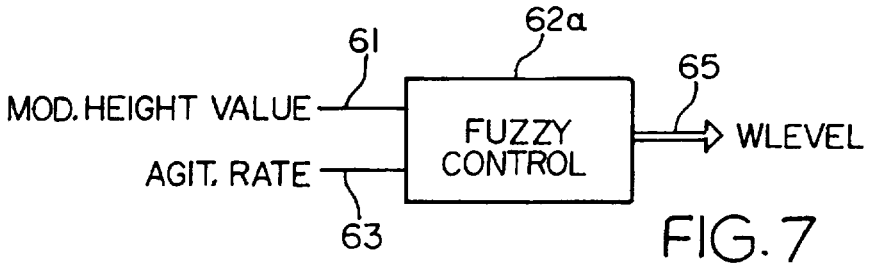
FIG. 7 is a simple schematic diagram of the fuzzy controller of the automatic washer of FIG. 1.

As shown in FIG. 7, the modified height value MH is communicated to the microprocessor 62 along line 61 and signal representative of the agitation speed is sent to the microprocessor 62 along line 63, as previously described. The microprocessor 62 includes fuzzy control logic, herein called fuzzy control unit **62*a*, for determining the optimum water level, the output of the fuzzy control 62*a* being a value which represents the frequency of the analog water level pressure transducer for the output water level. The fuzzy control 62*a*** executes three fuzzy logic stages: fuzzification, rule application and defuzzification, according to the fuzzy theory. The fuzzy logic control may be defined and encoded in Motorola 68HC05 assembly code.

Figure 8A:
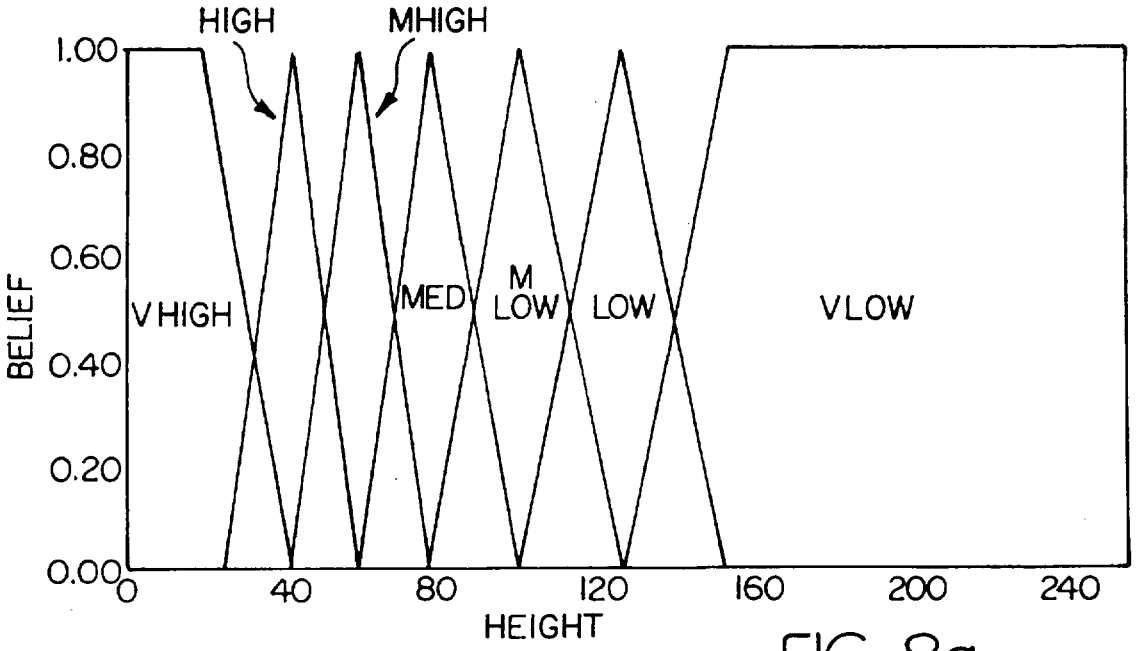
FIGS. 8*a* and 8*b* illustrate input membership functions for the clothes height value and the agitator speed value.
Figure 8B:
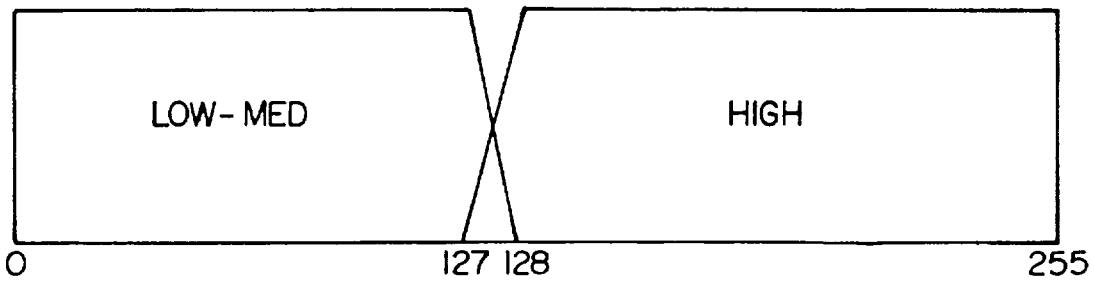

In the fuzzification stage, the systems inputs are manipulated and mapped to linguistic values or fuzzy inputs through a set of predetermined membership functions. FIGS. **8*a* and 8*b* show membership functions for the input variables, modified height MH and agitation rate AR, for the fuzzy inference of the fuzzy control 62*a*. In the modified height MH input membership function, FIG. 8*a*, the ordinate represents the degree of membership and the abscissa represents the modified height value received on line 61**. The modified height value ranges from an internal scale from 0 to 255. The triangularly shaped membership functions map the range of clothes height values to degree of membership in the fuzzy sets based on an experts knowledge. For example, it can be seen that a modified height value having an internal scale value of 50 includes a 0.5 membership in the MHIGH clothes height set and a 0.5 membership in the HIGH clothes height set. In this fashion, partial membership in more than one set may be accommodated, according to the fuzzy theory.

In the agitator rate AR input membership function, FIG. **8*b*, the ordinate represents the degree of membership and the abscissa represents the agitator speed for the selected cycle. In the preferred embodiment, as contemplated by the inventor, the automatic washer 10 includes controls for operating the motor to drive the agitator 18** at a selected high, medium or low speed of agitation. The agitation rate AR input is a single value set to 0 for low and medium speed agitation and set to 255 for high speed agitation. In this fashion, it can be seen that a low or medium speed agitation rate leads to an input value fully belonging to the LOW-MED membership function while a high speed agitation rate fully belongs to the HIGH membership function.

As described above, the agitator speed will have full membership in either the LOW-MED membership function or the HIGH membership function. However, as contemplated by the inventor, the present invention may readily lend itself to use with a variable speed motor wherein a set of input membership functions may be developed such that partial membership in different membership functions may be provided.

Figures 9, 10:
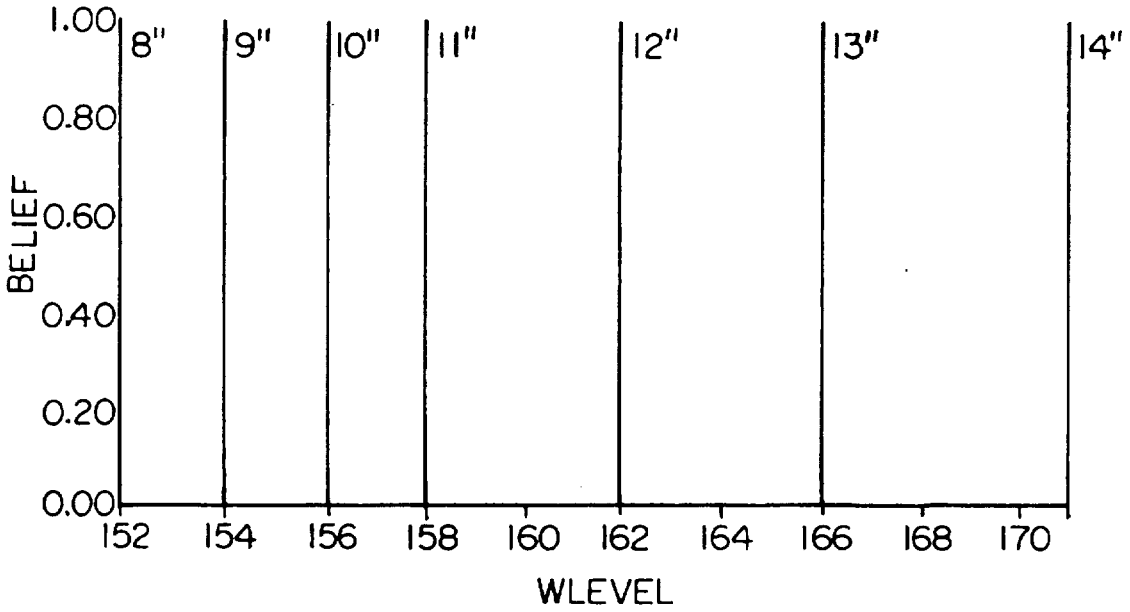
FIG. 9 illustrates the fuzzy logic rule base.
FIG. 10 illustrates the output membership function for translated the output set to a water level value.

In the rule application stage, the logic rules are applied to the set of linguistic input set values or input membership values to derive a set of linguistic output values or conclusions. FIG. 9 illustrates the fuzzy logic rule base applied to the input membership values for determining conclusions or output values for developing an output set. By use of the fuzzy logic rules, a fuzzy inference may be made regarding the linguistic input values from the input membership functions. The rules represent an experts knowledge of water level control based on the size of the wash load and the type of wash cycle selected. Specifically, the rules define conclusions which represent washing liquid levels in the wash tub, based on the input membership function values. For example, in a case #1, where the agitation rate AR linguistic value is HIGH and the modified height MH linguistic value is MHIGH, the conclusion or output water level value is defined as TWELVEIN.

The degree membership of the output values or conclusions equals the minimum degree of membership of the input values. For example, in a case #2, where the agitation rate AR linguistic value is HIGH and the modified height MH linguistic value is 0.5 MHIGH and 0.5 HIGH, the output water level values are defined as 0.5 THIRTEENIN and 0.5 TWELVEIN.

In the defuzzification stage, the set of rule outputs or output linguistic water level values are applied to an output membership function, illustrated in FIG. 10 for determining the fuzzy controller output for controlling the water level in the wash tub. In this fashion, the set of rule outputs are converted to a single byte output water level through the application of the output membership functions. For the output membership functions, the membership functions are defined as singletons. From the case #1, therefore, when the linguistic output consequent water level value is TWELVEIN, the output membership function converts that linguistic value into a single byte value 162 representative of the desired frequency of the analog fluid pressure transducer 78 wherein the water level may be controlled. From case #2, where the output water level values were 0.5 THIRTEENIN and 0.5 TWELVEIN, a weighted summation of the output membership function provides for an output value of 164 representative of the desired frequency of the analog fluid pressure transducer 78 for controlling the water level.

In this fashion therefore, a novel automatic system for determining the optimum quantity of washing liquid in an automatic washer is provided. More specifically, a fuzzy control system utilizing the inputs of clothes height and agitator speed is provided for determining the optimum water level.

Although the present invention has been described with reference to a specific embodiment, those of skill in the Art will recognize that changes may be made thereto without departing from the scope and spirit of the invention as set forth in the appended claims.

We claim:

1. A system for controlling the quantity of wash liquid supplied to an automatic washer, said automatic washer having a wash tub, a wash basket rotatably disposed in the wash tub, an agitator rotatably disposed in said basket and a wash liquid inlet device selectively operable to supply wash liquid to the wash basket, wherein said wash basket is adapted for receiving a clothes load, said system comprising:

a clothes height measuring system for measuring the height of the clothes load disposed in said wash basket;

washing liquid level inference control means using a fuzzy inference operation for making an inference as to an optimum washing liquid level based on the clothes height, and control means for regulating said wash liquid inlet device to fill said wash basket to said optimum washing liquid level.

2. The system for controlling the quantity of wash liquid supplied to an automatic washer according to claim 1, further comprising:

a motor drivingly interconnected with said agitator for selectively driving said agitator; and means for determining the agitator speed, said washing liquid level inference control means using said fuzzy inference operation for making an inference as to an optimum washing liquid level based on the clothes height and the agitator speed.

3. The system for controlling the quantity of wash liquid supplied to an automatic washer according to claim 2, said means for determining the agitator speed further comprising:

means for allowing user input for selectively operating the washer through a programmed sequence of washing, rinsing and spinning steps; and means for determining the selected agitator speed from said user input.

4. The system for controlling the quantity of wash liquid supplied to an automatic washer according to claim 2, said washing liquid level inference control means further comprising:

a clothes height degree of membership value determining means for determining a clothes height membership value based on the height of the clothes load and a set of clothes height membership functions;

an agitator rate value determining means for determining an agitator rate degree of membership value based on the agitator rate and a set of agitator rate membership functions;

means for applying a set of washing liquid level inference rules to said clothes degree of height membership value and said agitator rate degree of membership value for determining conclusions;

means for determining the level of washing liquid supplied to said wash tub based on said conclusions; and means for applying said conclusions to an output membership function for determining the optimum washing liquid level.

5. The system for controlling the quantity of wash liquid supplied to an automatic washer according to claim 1 wherein said clothes height measuring system further comprises:

a sonic transducer for directing a plurality of sonic pulses into said wash basket having said load of clothes disposed therein and further for receiving a plurality of sonic echo pulses from said load of clothes, said sonic echo pulses being the reflections of said sonic pulses from said load of clothes;

means for rotating said wash basket while transmitting said plurality of sonic pulses and receiving said plurality of sonic echo pulses; and means for determining the height of said load of clothes in said wash basket in response to said plurality of sonic echo pulses.

6. A system for controlling the quantity of wash liquid supplied to an automatic washer, said automatic washer having a wash tub, a wash basket rotatably disposed in the wash tub, a wash liquid inlet device selectively operable to supply wash liquid to the wash basket, and an agitator rotatably disposed in the wash tub, wherein said wash basket is adapted for receiving a clothes load, said system comprising:

a clothes height measuring means for measuring the height of the clothes load disposed in said wash basket;

a motor drivingly interconnected with said agitator for selectively driving said agitator;

means for allowing user input for selectively operating the washer through a programmed sequence of washing, rinsing and spinning steps;

means for determining the selected agitator speed; and fuzzy control means for receiving a signal from said clothes height measuring means and said agitator rate determining means for controlling the quantity of wash liquid supplied to said wash tub by said wash liquid inlet device.

7. The system for controlling the quantity of wash liquid supplied to an automatic washer according to claim 6 wherein said clothes height measuring system further comprises:

a sonic transducer for directing a plurality of sonic pulses into said wash basket having said load of clothes disposed therein and further for receiving a plurality of sonic echo pulses from said load of clothes, said sonic echo pulses being the reflections of said sonic pulses from said load of clothes;

means for rotating said wash basket while transmitting said plurality of sonic pulses and receiving said plurality of sonic echo pulses; and means for determining the height of said load of clothes in said wash basket in response to said plurality of sonic echo pulses.

8. The system for controlling the quantity of wash liquid supplied to an automatic washer according to claim 6, said washing liquid level inference control means further comprising:

a clothes height degree of membership value determining means for determining a clothes height membership value based on the height of the clothes load and a set of clothes height membership functions;

an agitator rate value determining means for determining an agitator rate degree of membership value based on the agitator rate and a set of agitator rate degree of membership functions;

means for applying a set of washing liquid level inference rules to said clothes degree of height membership value and said agitator rate degree of membership value for determining conclusions;

means for determining the level of washing liquid supplied to said wash tub based on said conclusions; and means for applying said conclusions to an output membership function for determining the optimum washing liquid level.

9. A method of controlling the quantity of wash liquid supplied to an automatic washer, said automatic washer having a wash tub, a wash basket rotatably disposed in the wash tub, a wash liquid inlet device selectively operable to supply wash liquid to the wash basket, an agitator rotatably disposed in the wash tub and a motor drivingly interconnected for selectively rotating the agitator, wherein said wash basket is adapted for receiving a clothes load, the method comprising the steps of:

measuring a height value of the clothes load disposed in said wash basket;

mapping said height value to values in accordance with predetermined input membership functions to obtain input clothes height set values;

applying predetermined logic rules to said input clothes height set values to derive values for an output set;

applying said output set values to predetermined output membership functions for arriving at a optimal washing liquid fill level; and operating said wash liquid inlet device such as to fill said basket to said optimal washing liquid fill level.

10. The method of controlling the quantity of wash liquid supplied to an automatic washer according to claim 9, further comprising the steps of:

determining an agitator speed value;

mapping said agitator speed value to values in accordance with predetermined input membership functions to obtain input agitator speed set values;

applying predetermined logic rules to said input clothes height and agitator speed set values to derive values for a combined output set; and applying said combined output set values to predetermined output membership functions for arriving at said optimal washing liquid fill level.

11. The method of controlling the quantity of wash liquid supplied to an automatic washer according to claim 9 wherein said step of measuring a height value of the clothes load disposed in said wash basket further comprising the steps of:

rotating said wash basket; while transmitting a plurality of sonic pulses and directing said plurality of sonic pulses into said wash basket having said load of clothes disposed therein;

receiving a plurality of sonic echo pulses from said load of clothes prior to supplying wash liquid into said wash basket for washing said clothes load, said plurality of sonic echo pulses being the reflections of said sonic pulses from said load of clothes; and determining a clothes height for the clothes load in response to said plurality of sonic echo pulses.

12. A system for controlling the quantity of wash liquid supplied to an automatic washer, said automatic washer having a wash tub, a wash liquid inlet device selectively operable to supply wash liquid to the wash basket, a wash basket rotatably disposed in the wash tub and an agitator rotatably disposed in the wash tub, wherein said wash basket is adapted for receiving a clothes load, said system comprising:

a clothes height measuring means for measuring the height of the clothes load disposed in said wash basket;

a motor drivingly interconnected with said agitator for selectively driving said agitator;

means for allowing user input for selectively operating the washer through a programmed sequence of washing, rinsing and spinning steps;

means for determining the selected agitator speed; and means for controlling the quantity of wash liquid supplied to said wash tub by said wash liquid inlet device in response to said clothes height measuring means and said agitator rate determining means.

13. The system for controlling the quantity of wash liquid supplied to an automatic washer according to claim 12 wherein said clothes height measuring system further comprises:

a sonic transducer for directing a plurality of sonic pulses into said wash basket having said load of clothes disposed therein and further for receiving a plurality of sonic echo pulses from said load of clothes, said sonic echo pulses being the reflections of said sonic pulses from said load of clothes;

means for rotating said wash basket while transmitting said plurality of sonic pulses and receiving said plurality of sonic echo pulses; and means for determining the height of said load of clothes in said wash basket in response to said plurality of sonic echo pulses.

14. The system for controlling the quantity of wash liquid supplied to an automatic washer according to claim 12, said means for controlling the quantity of wash liquid supplied to said wash tub by said wash liquid inlet device in response to said clothes height measuring means and said agitator rate determining means further comprising:

a clothes height degree of membership value determining means for determining a clothes height membership value based on the height of the clothes load and a set of clothes height membership functions;

an agitator rate value determining means for determining an agitator degree of rate membership value based on the agitator rate and a set of agitator rate membership functions;

means for applying a set of washing liquid level inference rules to said clothes height degree of membership value and said agitator rate degree of membership value for determining conclusions; and means for determining the level of washing liquid supplied to said wash tub based on said conclusions; and means for applying said conclusions to an output membership function for determining the optimum washing liquid level.

* * * * *